US008573012B1

(12) United States Patent
Paulson

(10) Patent No.: US 8,573,012 B1
(45) Date of Patent: Nov. 5, 2013

(54) INDEXING SYSTEM FOR CORRUGATED METAL FORMING

(76) Inventor: Wallace S. Paulson, Corona Del Mar, CA (US)

( * ) Notice: Subject to any disclaimer, the term of this patent is extended or adjusted under 35 U.S.C. 154(b) by 0 days.

(21) Appl. No.: 13/586,452

(22) Filed: Aug. 15, 2012

Related U.S. Application Data

(60) Provisional application No. 61/525,112, filed on Aug. 18, 2011.

(51) Int. Cl.
*B21B 38/00* (2006.01)
*B21B 37/16* (2006.01)

(52) U.S. Cl.
USPC ..... 72/8.3; 72/11.2; 72/31.07; 72/234; 700/150

(58) Field of Classification Search
USPC ..... 72/8.1, 8.3, 11.1, 11.2, 31.07, 176, 177, 72/179, 181, 182, 197, 234, 379.6; 700/148–156
See application file for complete search history.

(56) References Cited

U.S. PATENT DOCUMENTS

| | | | | |
|---|---|---|---|---|
| 317,868 | A | 5/1885 | Smith | |
| 899,817 | A | 9/1908 | Ward | |
| 1,677,031 | A | 7/1928 | Kuehn | |
| 2,007,284 | A | 7/1935 | Rafter | |
| 2,251,967 | A | 8/1941 | Yoder | |
| 2,294,324 | A | 8/1942 | Wilkens et al. | |
| 2,471,490 | A | 8/1945 | Mercer | |
| 2,505,241 | A | 4/1950 | Gray et al. | |
| 2,664,177 | A | 12/1953 | Hammitt et al. | |
| 2,781,877 | A | 2/1957 | Ochiltree | |
| 3,137,922 | A | 6/1964 | Schumacher | |
| 3,344,641 | A | 10/1967 | Pomory | |
| 3,462,989 | A | 8/1969 | Fischer, Jr. | |
| 3,918,626 | A * | 11/1975 | McLain | 72/196 |
| 3,992,162 | A | 11/1976 | Gewiss | |
| 4,220,423 | A | 9/1980 | Sivachenko | |
| 4,526,024 | A | 7/1985 | Toti | |
| 4,578,978 | A | 4/1986 | Onoda et al. | |
| 4,662,734 | A | 5/1987 | Nishi | |
| 4,876,837 | A | 10/1989 | Kelly et al. | |
| 5,489,463 | A | 2/1996 | Paulson | |
| 5,609,053 | A * | 3/1997 | Ferreira et al. | 72/234 |
| 6,766,843 | B2 | 7/2004 | Hilt et al. | |
| 7,031,797 | B2 * | 4/2006 | Reinschke et al. | 700/150 |
| 7,421,947 | B2 | 9/2008 | Bryan | |
| 7,677,071 | B2 | 3/2010 | Heirich | |
| 7,879,174 | B2 | 2/2011 | Borazghi | |
| 2007/0220941 | A1 * | 9/2007 | Kleinfeldt et al. | 72/234 |
| 2010/0263424 | A1 | 10/2010 | Madhavan et al. | |
| 2011/0104512 | A1 | 5/2011 | Rapp et al. | |

* cited by examiner

*Primary Examiner* — Dana Ross
*Assistant Examiner* — Pradeep C Battula
(74) *Attorney, Agent, or Firm* — Klein, O'Neill & Singh, LLP

(57) ABSTRACT

The present invention provides apparatus, systems, and methods in which a sheet material roll forming system has n sets of rollers configured to simultaneously bend the sheet material in number of different directions and adjustment mechanisms operatively coupled with the sets of rollers and capable of disengaging rollers in a selected roller set from the sheet material, then rotating and/or translating the rollers in the selected roller set and reengaging the rollers with the sheet material passing through the rollers as a function of sensing a plurality of markings on the sheet material and the rollers.

9 Claims, 4 Drawing Sheets

INDEXING SYSTEM FOR CORRUGATED METAL FORMING

CROSS-REFERENCE TO RELATED APPLICATIONS

This application claims priority of U.S. Provisional Application No. 61/525,112, filed Aug. 18, 2011, the entire disclosure of which is incorporated in its entirety herein, by this reference thereto.

FIELD OF THE INVENTION

The field of the invention is roll forming of sheet materials.

BACKGROUND

Sheet metal forming systems and processes are commonly used to fabricate parts and members that can be used to construct and/or assemble various structures. U.S. Pat. No. 5,337,592 to Paulson discloses a roll forming process that includes a plurality of sets of non-axisymmetrical rollers serially positioned and configured to bend sheet material in a plurality of directions (e.g., longitudinally, lateral, transverse). The resulting corrugated member is a longitudinally cyclically variable cross-section member having multiple folds and bends. U.S. Pat. No. 5,489,463 to Paulson discloses a similar roll forming process that is used to form a complex member having numerous bends in different directions.

This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Other roll forming processes are disclosed in U.S. Pat. Nos. 317,868, 899,817, 1,677,031, 2,007,284, 2,251,967, 2,294,324, 2,471,490, 2,505,241, 2,664,177, 2,781,877, 3,137,922, 3,344,641, 3,462,989, 3,992,162, 4,220,423, 4,526,024, 4,578,978, 4,662,734, and 4876837.

The Paulson patents teach spacing the sets of rollers at a predetermined distance apart, and driving the rollers at a predetermined speed, based on a calculation of the amount of bending and "longitudinal shortening" that occurs between each set of rollers. As used herein, the term "longitudinal shortening" refers to a change in the longitudinal dimension of the sheet material per cycle of the roll forming process, (i.e., comparison of the longitudinal length of the sheet material before and after each roll-forming step). Unfortunately, many factors can contribute to a lack of precision in the calculated longitudinal shortening. For example, the actual thickness, yield strength, stiffness and spring back characteristics of the specific sheet material being bent cause significant variation in longitudinal shortening. Other factors include machine dimensional tolerances and drive motor speed variances. Considering all these factors, the probability of each sequential roller forming station adequately aligning with the bend increment in the sheet material is most unlikely if based solely on a pre-calculated estimate of longitudinal shortening. The Paulson patents, and all other known prior art, fail to provide an active alignment system that can compensate for variations in longitudinal shortening. As used herein, the term "alignment" refers to the relational position between bends in a sheet material and a roller forming station (e.g., rollers).

U.S. Patent Application Publication No. 2011/0104512 to Rapp appreciates the fact that roll forming under pressure can cause the sheet material to stretch in the longitudinal direction. Rapp also discloses varying the speed of the rollers in order to control the amount of longitudinal stretching. However, Rapp fails to compensate for variations in longitudinal shortening in order to solve the problem of misalignment.

U.S. Pat. No. 7,677,071 to Heirich discloses a sheet material roll forming process that has a variable speed motor and a driving gear coupled with a driven gear. The driving gear and driven gear can slide out of gear from one another to create a slack loop in the sheet material. U.S. Patent Application Publication No. 2010/0263424 to Madhavan discloses using optical sensors to sense a strain in a sheet material as it passes through rollers, and adjusting the speed of the rollers as a function of the strain. Variable speed electric motors for driving rollers are also taught in U.S. Pat. Nos. 6,766,843, 7,421,947, and 7,879,174. While these references contemplate that variable speed motors can be used in roll forming, the references fail to solve alignment problems caused by variations in longitudinal shortening.

Thus, there is still a need for roll forming tools and processes that compensate for variations in longitudinal shortening caused by bending into a formed shape.

SUMMARY OF THE INVENTION

The existing U.S. Pat. No. 5,337,592 defines a modified roll form tool in a nominal configuration, by spacing the sequential roller sets at nominally calculated spacing and roller clocking geometries.

The reality of everything converging with such precision is not to be expected in the real world. Many factors can contribute to lack of precision in the longitudinal placement of the serially growing bend line locations. Among those factors are: the actual thickness, yield strength, stiffness and spring back characteristics of the specific sheet material being bent; machine dimensional tolerances; and drive motor speed variances. Considering all these deviations, the probability of the bend increment at each sequential roller forming station adequately aligning with the entering product bend increment is most unlikely. An active alignment system must be included to assure the ultimate formed product meets the intended purpose of the machine and its product.

The initial first action in assuring this proper alignment is to establish index marks on the product material about to be fed into the roll form machine. Sometime before or at the point the supply sheet material is introduced into the first roller set, an index mark is located at a pre-selected station on the flat material, a station chosen as a reference point on the flat pattern determined for the specific product to be fabricated. This index mark will be repeated sequentially at each cycle pattern in turn.

Similar index points are located on each of the roller sets, again representing the same reference point as the evolving product traverses through the serial forming stations. Each station roller configuration is designed to contain a preselected number of cycles of formed product, n, n being 1 or a larger whole number. Each cycle will be marked with an index mark to match the exact location of the reference point as the forming part is fore-shortened axially, caused by the bending—only characteristic of the forming machine. Each roller will then have a family of index marks around its girth representing the n number of cycles in that roller.

Each roller set will be pre-positioned, both longitudinally and rotationally, in the machine assembly to engage the approaching product per the original patent's plan for nominal geometric calculations. The now-included index marks form the basis for adjusting the product to roller mating geometry as the product is introduced into each sequential roller set in real time, during the rolling operation or process.

The actual adjustment protocol at each roller set may include the following set of actions:

1. As the product index mark approaches the roller index mark, sensors will sense and compare their positions relative to exact matching. If the measurement is within a given acceptable tolerance, no action will be taken; the forming process will continue as normal.
2. If the comparison difference exceeds the pre-determined acceptable tolerance, the difference calculation will cause three actions to take place:
   a. A vertical force will momentarily cause the rollers to relax and release the clamping action on the sheet material.
   b. Two alternative methods can be used to reposition (i.e., realign) the rollers with respect to the approaching sheet material;
      (1) a rotational force will adjust the rotational position of the rollers or;
      (2) a translational force will move the roller set longitudinally.
   c. After the rollers have been repositioned, the rollers are re-engaged with the sheet material.

These adjustments in the rotational position or the longitudinal translation of the receiving rollers are quite small and are accommodated in the short interval of time that the roller clamping forces, where they meet the sheet material, are eliminated. By continually verifying said alignments at each cycle, small adjustments will only need to be performed infrequently, not at each cycle.

The inventive subject matter provides apparatus, systems, and methods in which a sheet material roll forming system comprises: (i) a first set of rollers configured to simultaneously bend the sheet material in a plurality of directions; (ii) a second set of rollers configured to releasably engage the sheet material and simultaneously bend the sheet material in a plurality of directions; and (iii) a disengagement mechanism coupled with the second set of rollers and configured to disengage the sheet material as a function of sensing a plurality of markings on the sheet material when a sensor system indicates excessive alignment errors.

In one aspect of some preferred embodiments, the sheet material is simultaneously bent in a number of directions. Those of skill in the art will appreciate that various corrugated designs can be used consistently with the inventive concepts discussed herein, based on the different directions chosen, and the number of additional roller sets included. In some aspects of preferred embodiments, the system includes more than three roller sets or stations, wherein each set or station is configured to incrementally bend the sheet material. In yet other aspects, each roller set or station can include more than two rollers.

The sheet material most commonly comprises a metal. However, any bendable material is contemplated.

In other aspects of preferred embodiments, the plurality of markings comprise a plurality of indentations. Alternatively, the plurality of markings can comprise a plurality of visual indications/marks (e.g., colored lines or dots). In other preferred embodiments, the plurality of markings comprise a plurality of focal points corresponding to a plurality of bends. In yet other preferred embodiments, the plurality of markings comprise a plurality of holes or notches.

In yet other aspects of preferred embodiments, the first set of rollers includes an indexing station configured to provide the plurality of markings as the sheet material passes through the first set of rollers. However, it is also contemplated that an indexing station dedicated solely to marking the sheet material with a plurality of markings (and not roll form the sheet material) can be included at some location upstream of (i.e., prior to) the first set of rollers. In such cases, care must be used in locating the indexing station, in order to properly align the markings with the bends formed by the first roller station.

In some embodiments, the roll forming system includes a sensor system configured to detect the plurality of markings and communicate the location of the markings to each disengagement mechanism.

In other aspects of preferred embodiments, a disengagement mechanism controls a relational position between the second set of rollers (e.g., separates and/or brings together the rollers).

In some aspects of preferred embodiments, the roll forming system may further include additional sets of rollers configured to releasably engage the sheet material and bend the sheet material; and additional disengagement mechanisms coupled with the additional sets of rollers and configured to disengage the sheet material as a function of the plurality of markings on the sheet material. In this manner, all sets of rollers work together to gradually and incrementally bend the sheet material into a desired shape/configuration.

Broadly, the present invention includes a sensor system that calculates actual alignment errors at each roller set receiving sheet material partially formed into a desired product configuration by: reading positional information of a product's markers as it approaches a roller set; comparing this information with a similar reading from the markers located on the roller set itself; calculating corrective actions as required; and, if action is needed, engaging the disengagement mechanism at the roller set to release the sheet material and allow roller adjustment. The roller adjustment may be either or both a longitudinal repositioning of the roller set, or a rotation of rollers. The roller disengagement mechanism is then closed to re-engage the sheet material. This procedure is repeated at each consecutive roller set, if needed, by an indication from the sensor system.

Various objects, features, aspects, and advantages of the inventive subject matter will become more apparent from the following detailed description of preferred embodiments, along with the accompanying drawing figures in which like numerals represent like components.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

DETAILED DESCRIPTION

Figure 1:
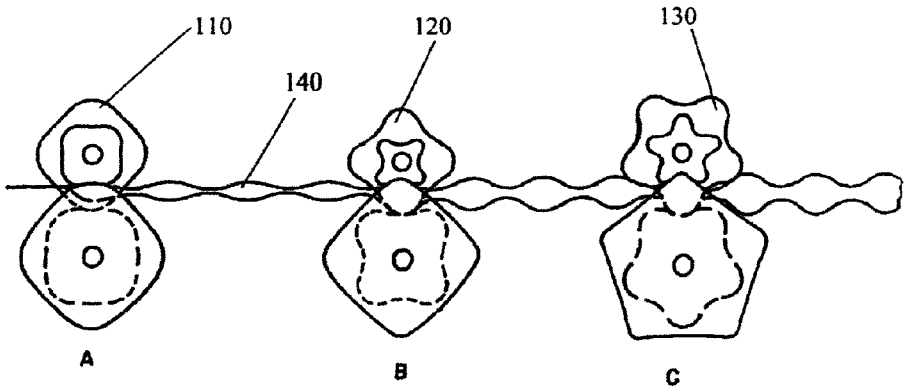
Figure 1 (PRIOR ART)
FIG. 1 shows the prior art roll forming system disclosed in U.S. Pat. No. 5,337,592.
Figure 2:
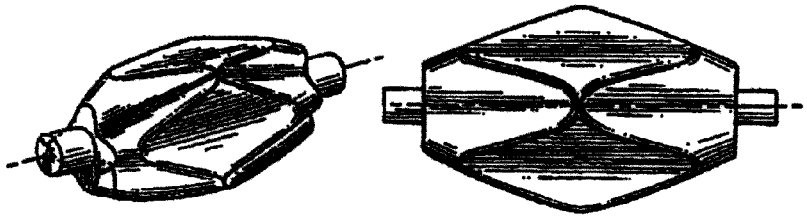
Figure 2 (PRIOR ART)
FIGS. 2 and 3 show a configuration of rollers that can be paired together at a roller station, as disclosed in U.S. Pat. No. 5,337,592.
Figure 3:
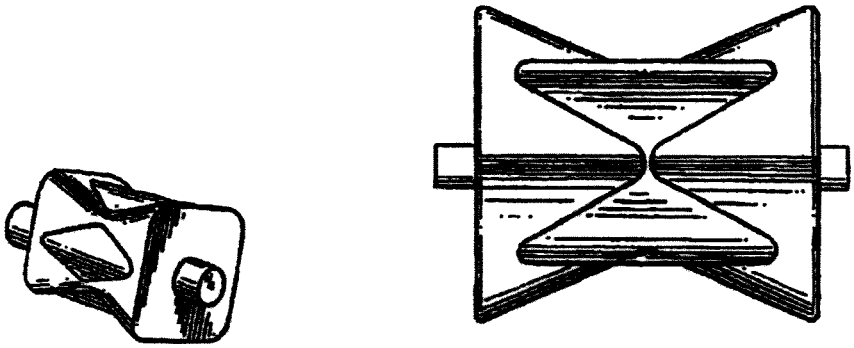
Figure 3 (PRIOR ART)
Figure 4:
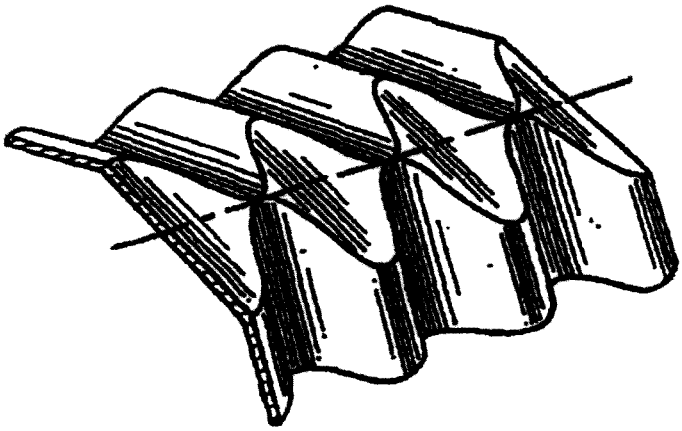
Figure 4 (PRIOR ART)
FIG. 4 shows an example of a resulting corrugated member, as disclosed in U.S. Pat. No. 5,337,592.

As shown in FIG. 1, a first set of rollers 110, a second set of rollers 120, and a third set of rollers 130 are serially positioned and configured to incrementally bend sheet material 140. For example, each roller station is configured to bend the sheet material in a similar manner, but with a progressing degree of bend in order to gradually form the sheet material into the desired corrugated pattern.

Figure 5A:
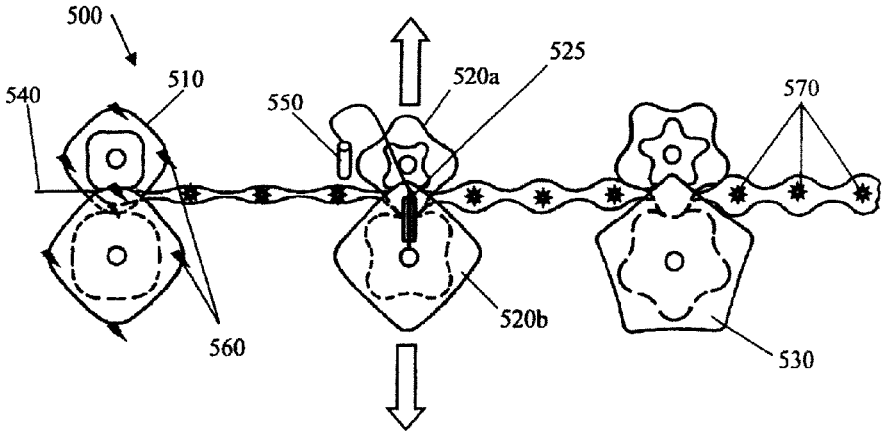
FIGS. 5*a* and 5*b* shows one form of a sheet material roll forming system of the present invention.
Figure 5B:
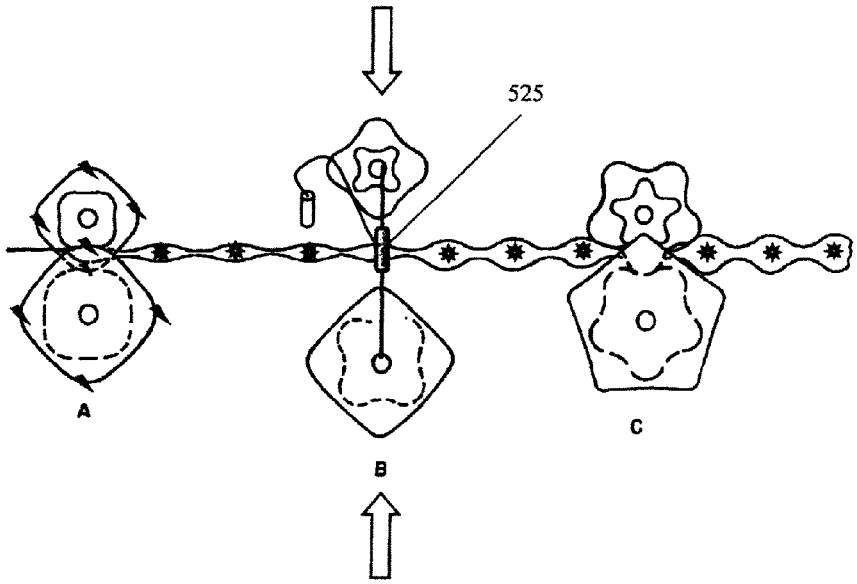

FIGS. 5*a* and 5*b* show a sheet material roll forming system 500, comprising a first set of rollers 510, a second set of rollers 520, and a third set of rollers 530, serially positioned. As sheet material 540 passes through each set of rollers, material 540 is incrementally bent, causing material 540 to shorten longitudinally. First set of rollers 510 has markers 560 that mark material 540 with marks 570 as it passes through rollers 510. Marks 570 can comprise indentations, visual markings, holes, or any other marking/indication that can be detected and used to control the speed of rollers 520. In some embodiments, the markings are the focal point of the bends caused by first set of rollers 510.

A sensor 550 is placed just before sheet material 540 passes through second set of rollers 520. Sensor 550 is configured to detect marks 570, and provide the information to disengagement mechanism 525. Disengagement mechanism 525 controls the distance between roller 520*a* and 520*b* as a function of the distance between each mark. When sheet material 540 shortens longitudinally more than previously calculated (due to various factors that cause imprecision in the calculation), disengagement mechanism 525 separates rollers 520*a* and 520*b*, thus "disengaging" (i.e., releasing) material 540. Rollers 520*a* and 520*b* can then re-engage material 540 at the appropriate point. When material 540 shortens longitudinally less than previously calculated (again, due to various factors), mechanism 525 can be actuated to disengage rollers 520*a* and 520*b* from material 540. Once rollers 520*a* and 520*b* have disengaged material 540, a motor (not shown) coupled to rollers 510 can slow the rotational speed of rollers 510, and mechanism 525 can be operated so that rollers 520*a* and 520*b* re-engage material 540 at the proper location. The motor can then be re-adjusted back to an appropriate rotational speed. In this manner, system 500 can be employed to incrementally bend a sheet material while simultaneously compensating for variations in longitudinal shortening.

It is also contemplated that the third set of rollers 530 can include a second optical sensor and disengagement mechanism (not shown) in order to adjust for variations in longitudinal shortening caused by second set of rollers 520. One of ordinary skill in the art will appreciate that any number of rollers, sensors, and disengagement mechanisms can be used consistently with the inventive subject matter discussed herein. Furthermore, while optical sensors are specifically contemplated, one of skill in the art will appreciate that sensor 550 could rely on non-optical sensing means (e.g., mechanical, magnetic, chemical, audio).

Figure 6:
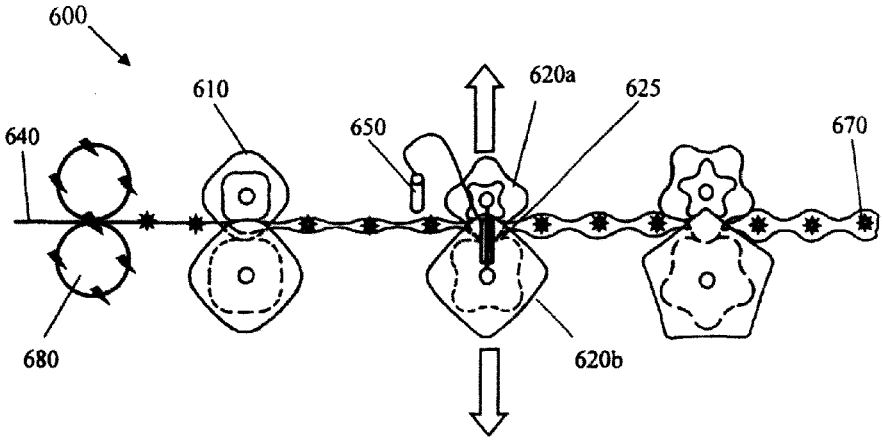
FIG. 6 shows a further form of a sheet roll forming system of the present invention.

FIG. 6 shows a further sheet material roll forming system 600. System 600 is similar to system 500 except that a separate indexing station 680 has been placed just upstream of first set of rollers 610. Indexing station 680 is configured to index (i.e., mark) sheet material 640 without substantially bending or deforming sheet material. The sheet material roll forming system 600 includes a sensor or sensor system 650.

Figure 7:
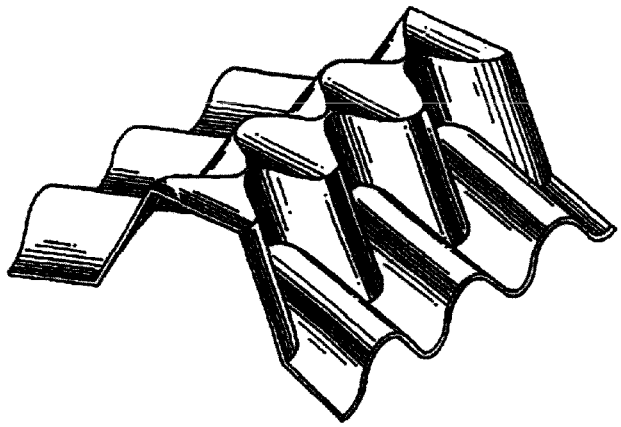
FIG. 7 shows one example of a complex corrugated design that can be achieved by the improved roll forming processes and systems disclosed herein.

The complex corrugated design shown in FIG. 7 can be accurately formed by the systems of the present invention. And, although this design has been previously contemplated (see U.S. Pat. No. 5,337,592, FIG. 16), the prior art roll forming tools, processes, and systems have not been able adequately achieve such complex shapes due to lack of an active alignment system (i.e., the prior roll former systems did not compensate for variations in longitudinal shortening).

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A sheet material roll forming system comprising:

a first set of rollers configured to bend the sheet material in at least one direction;

a plurality of further sets of rollers configured to releasably engage the sheet material and incrementally simultaneously bend the sheet material in at least one direction;

an indexing station configured to mark the sheet material with a plurality of markings; and disengagement mechanisms coupled with the plurality of further sets of rollers and configured to perform real time disengagement of the further sets of rollers from the sheet material as a function of comparing the markings on the sheet material with markings on the further sets of rollers to ensure that the mating geometry of the selected roller set and the approaching sheet material is properly aligned.

2. The roll forming system of claim 1, further comprising a sensor communicatively coupled with the disengaging mechanisms and configured to detect the plurality of markings.

3. The roll forming system of claim 2, wherein the sensor comprises a sensing system that calculates actual alignment error at each of the plurality of further sets of rollers.

4. The roll forming system of claim 3 wherein the sensing system reads positional information of the sheet material as it approaches each of the plurality of further sets of rollers; compares this positional information with a similar reading from markers located on each of the plurality of further roller sets; calculates corrective actions as required; and, if corrective actions are needed, engaging the required disengaging mechanisms between adjacent roller sets to allow further roller adjustment.

5. The roll forming system of claim 1, wherein the indexing station is included with the first set of rollers.

6. The roll forming system of claim 1, wherein the indexing station is positioned upstream of the first set of rollers.

7. A sheet material roll forming system comprising:

a serial arrangement of a plurality roller sets configured to incrementally bend a supplied sheet material simultaneously in a plurality of directions to produce a selected cyclically variable cross-sectioned member;

an adjustment mechanism at each of the roller sets for real time adjustment of the physical relationship between a selected roller set and the approaching partially formed cyclically variable cross-sectioned member using comparative analysis of sensor readings from a sensor system of the relative positions of the selected roller set and the approaching partially formed cyclically variable cross-sectioned member; and the adjustment mechanism including a disengagement mechanism at each roller set selectively operable in real time to temporarily disengage rollers in a selected roller set from an incoming partially formed cyclically variable cross-sectioned member while repositioning rollers in the selected roller set with respect to the approaching partially formed cyclically variable cross-sectioned member in accordance with positional calculations by the sensor system.

8. The roll forming system of claim 7, wherein the adjustment mechanism is operable to adjust the rotational position of a selected roller set, while the disengagement mechanism has disengaged the rollers of the selected roller set from the partially formed cyclically variable cross-sectioned member; the adjustment mechanism including a plurality of markings selected from a group consisting of: a plurality of indentations, slots or holes; a plurality of visual indications; and markings positioned at a major point in a bend pattern of an incoming partially formed cyclically variable cross-sectioned member; and further including an indexing station configured to provide the plurality of markings on the sheet material as the sheet material passes through the first set of rollers.

9. The roll forming system of claim 7, wherein the adjustment mechanism is operable to adjust the longitudinal position of a selected roller set, while the disengagement mechanism has disengaged the rollers of the selected roller set from the partially formed cyclically variable cross-sectioned member; the adjustment mechanism including a plurality of markings selected from a group consisting of: a plurality of indentations, slots or holes; a plurality of visual indications; and markings positioned at a major point in a bend pattern of an incoming partially formed cyclically variable cross-sectioned member; and further including an indexing station configured to provide the plurality of markings on the sheet material as the sheet material passes through the first set of rollers.

* * * * *